United States Patent [19]

Wieland

[11] 4,453,286

[45] Jun. 12, 1984

[54] VACUUM INDUCED TRASH COLLECTION SYSTEM

[76] Inventor: Clarence W. Wieland, 1531 Hyde St., #8, San Francisco, Calif. 94109

[21] Appl. No.: 487,374

[22] Filed: Apr. 21, 1983

[51] Int. Cl.[3] ..... A47L 5/38

[52] U.S. Cl. ..... 15/313; 15/301; 55/210

[58] Field of Search ..... 15/313, 314, 301, 340; 55/DIG. 34, 20, 210, 217

[56] References Cited

U.S. PATENT DOCUMENTS

| | | | |
|---|---|---|---|
| 2,299,668 | 10/1942 | Webster | 15/313 X |
| 3,062,363 | 11/1962 | Elswood | 15/313 X |
| 3,230,567 | 1/1966 | Nickless | 15/313 |
| 3,431,581 | 3/1969 | Booth | 15/313 |
| 3,648,837 | 3/1972 | Ogle | 206/19.5 C |
| 3,662,427 | 5/1972 | Hanna | 15/346 |
| 3,893,831 | 7/1975 | Doane | 55/217 X |
| 3,977,039 | 8/1976 | Block | 15/346 |

FOREIGN PATENT DOCUMENTS

| | | | |
|---|---|---|---|
| 60784 | 1/1967 | German Democratic Rep. | 15/313 |

*Primary Examiner*—Chris K. Moore

*Attorney, Agent, or Firm*—Townsend and Townsend

[57] ABSTRACT

A trash collection system for use on vehicles includes a main receptacle having an interior in which a partial vacuum is induced by a vacuum pump. A vacuum line network is connected to the main receptacle and includes one or more main collection lines extending along the rows of seats and feeder lines extending up between the individual seats. The upper ends of the feeder line are open allowing passengers to dispose of trash into the feeder line after first opening the spring-loaded lid. A liquid dispenser dispenses water into the main collection line to extinguish any lit material which may be disposed of into the system.

15 Claims, 5 Drawing Figures

VACUUM INDUCED TRASH COLLECTION SYSTEM

BACKGROUND OF THE INVENTION

Trash collection and disposal on an aircraft can become quite time consuming and burdensome for those working on the aircraft. This is especially true on relatively short flights when a large fraction of the flight attendants' time is spent collecting trash such as used napkins, dirty glasses, and empty peanut containers.

Vacuum induced trash collection systems have been devised for automobiles. U.S. Pat. No. 3,230,567, to Nickless, discloses a system in which a vacuum is used to draw litter into a common receptacle for removal later. U.S. Pat. No. 3,648,837, to Ogle, discloses a trash collection system having two separate litter paths, one for dry, bulky litter and the other for lit material, such as cigarettes. The lit material is drawn through a tube and is deposited into a waterfilled chamber.

Both of these systems suffer from significant drawbacks when contemplated for use aboard aircraft. A dual line system such as disclosed in Ogle impermissibly increases the bulk and weight of the system for aircraft uses. However, the system disclosed in the Nickless patent is also unsuitable for many applications since it lacks the ability to extinguish lit material, such as cigarettes.

SUMMARY OF THE INVENTION

The present invention is directed to a trash collection system for use on vehicles, particularly aircraft. A partial vacuum is induced by a vacuum pump within the interior of a main receptacle. A vacuum line network is connected to the main receptacle and includes one or more main collection lines extending along the rows of seats in the vehicle with feeder lines extending up between the individual seats.

The upper ends of the feeder lines are sealed by spring-loaded lids. Passengers dispose of trash into the feeder line after first opening the lid. The trash is drawn through the vacuum line network and into the main receptacle under the influence of the partial vacuum within the receptacle.

A liquid dispenser dispenses, or doses, liquid into the main collection line, preferably at a point adjacent the main receptacle, to extinguish any lit material, such as cigarettes, which may be disposed of into the system. If the liquid is dispensed continuously while the system is operational, i.e., while the vacuum pump draws a partial vacuum within the main receptacle, the extinguishing function is provided in two ways. First, the lit material is subjected directly to the dispensed liquid as it passes the liquid dosing equipment. Second, as all trash is wet down as it passes the liquid dosing equipment, the trash collected in the main receptacle is damp to effectively eliminate the possibility of the trash being ignited.

The present invention finds particular utility when used with commercial passenger aircraft. The automatic trash collection system eliminates numerous trips which would otherwise have to be made by the flight attendants. This not only saves time but it can reduce the number of employees required for each flight.

In an alternative embodiment, a heat sensor is mounted to the main collection line upstream of the outlet of the liquid dosing line. When the sensor senses that burning material is passing, it provides a signal to a controller which activates the liquid dosing equipment for a pre-determined time. In this manner the liquid dosing equipment does not operate continuously, but only intermittently as needed. Also, a shredder can be added to shred the trash prior to entering the main receptacle. The shredded trash takes up less room and reduces the possibility that lit material is not extinguished by the extinguishing liquid.

Other features and advantages of the present invention will appear from the following description in which the preferred embodiments have been set forth in detail in conjunction with the accompanying drawings.

DETAILED DESCRIPTION OF THE PREFERRED EMBODIMENT

Figure 1:
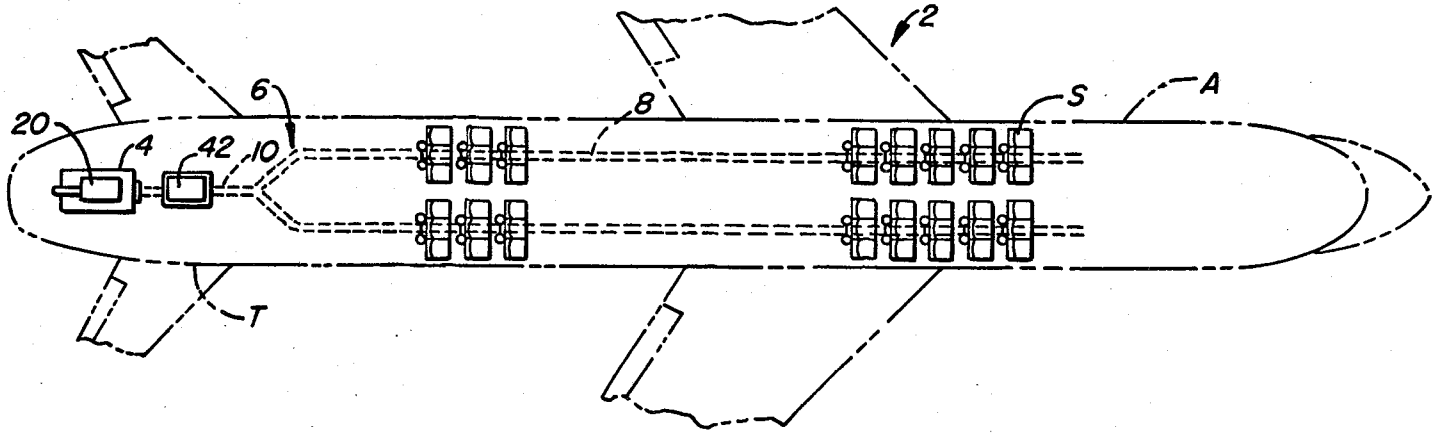
FIG. 1 is a plan view of the vacuum trash collection system of the invention adapted for use in a passenger airplane.
Figure 3:
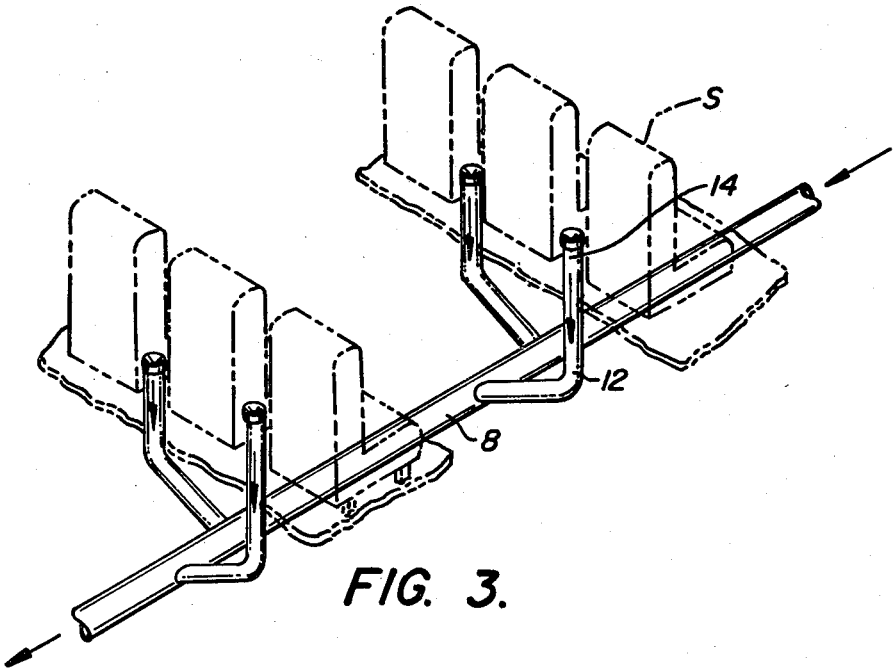
FIG. 3 is an enlarged view of a portion of the vacuum line network of FIG. 1 showing the feeder lines in relation to the airplane seats.

Turning now to FIGS. 1 and 3, the vacuum trash collection system 2 of the invention is shown mounted within an airplane A. System 2 includes a main receptacle 4 mounted near the tail T of airplane A. A vacuum line network 6 includes a pair of main collector lines 8, a common main collector line 10, and a number of feeder lines 12. The upper ends 14 of feeder lines 12 terminate adjacent the various seats S within airplane A.

Figure 2:
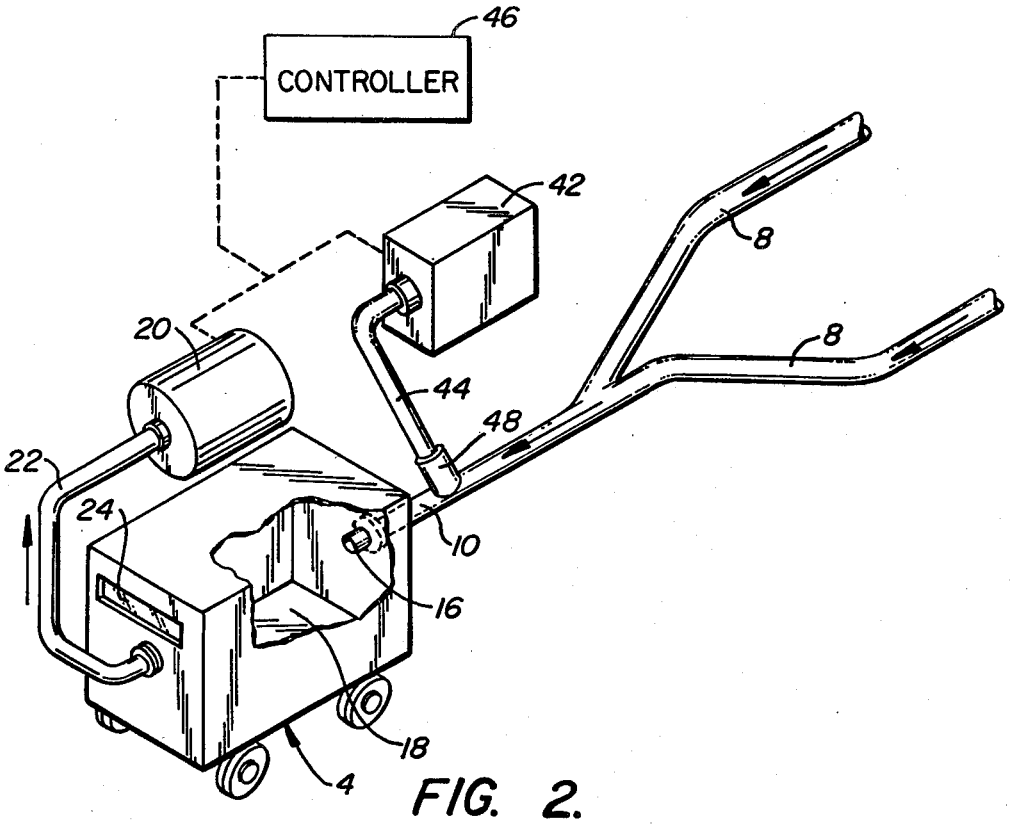
FIG. 2 is an enlarged view of a portion of the trash collection system of FIG. 1 showing the main receptacle and the liquid dosing equipment.

Referring now to FIG. 2, an open end 16 of common line 10 is mounted to main receptacle 4 and extends a short distance into the interior 18 of main receptacle 4. A partial vacuum is drawn on interior 18 by a vacuum pump 20 coupled to interior 18 by a vacuum line 22. The trash is introduced into network 6 by passengers opening a lid assembly 26 mounted to the open upper end 14 of feeder lines 12 and depositing their trash therein. Trash is drawn into interior 18 of the main receptacle 4 under the influence of the partial vacuum within the interior 18 through vacuum line network 6. A window 24 is provided in one of the walls of receptacle 4 to allow the amount of trash in the receptacle to be determined.

Figure 4:
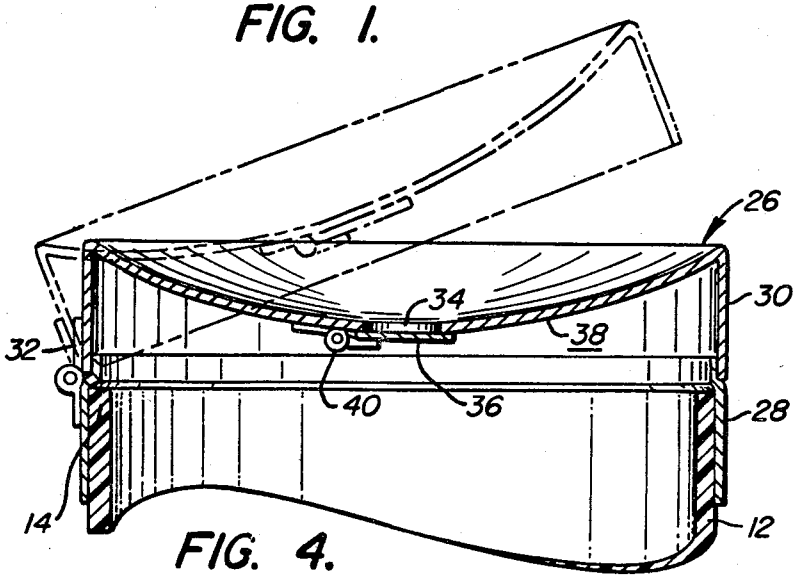
FIG. 4 is an enlarged view of the lid assembly mounted to the upper, open end of the feeder lines of FIG. 3.

Lid assembly 26, shown in FIG. 4, includes a retainer sleeve 28 mounted directly to open end 14 and a lid 30 mounted to the retainer sleeve by a spring loaded hinge 32. A small central opening 34 is formed within lid 30 for the deposit of small objects and ashes into network 6. Opening 34 is normally sealed by a flap 36 mounted to the underside 38 of lid 30 by a spring loaded hinge 40.

Water, or some other fire-extinguishing substance, is dispensed into common line 10 by a water dispenser 42 through a liquid dosing line 44. Dispenser 42 is controlled by a controller 46 which also controls the operation of vacuum pump 20. Controller 46 is preferably set up so that water dispenser 42 continuously injects water into common line 10 whenever pump 20 is actuated. Thus all trash pulled through network 6 becomes wet as it passes the outlet 48 of line 44 prior to entering interior 18 of main receptacle 4. Thus lit materials, such as improperly extinguished cigarettes, are extinguished by the water from dispenser 42. However, since all trash has a small amount of water applied to it, everything within interior 18 is at least damp. Therefore, even if a lit object is not completely extinguished by the direct application of liquid from dispenser 42, once it enters main receptacle 4, being surrounded by wet trash, it will soon become extinguised.

In use a passenger disposes of cups, napkins, and other trash by lifting lid 30 and inserting the trash into feeder line 12. The partial vacuum along network 6 draws the trash into main collection line 8, through common line 10 and into interior 18. Water is applied to the passing trash by dispenser 42 to extinguish lit material. Small articles, cigarette butts and ashes can be disposed of by depressing flap 36 and inserting the trash through opening 34 in lid 30. Main receptacle 4 is removed from airplane A periodically and the collected trash is disposed of.

Figure 5:
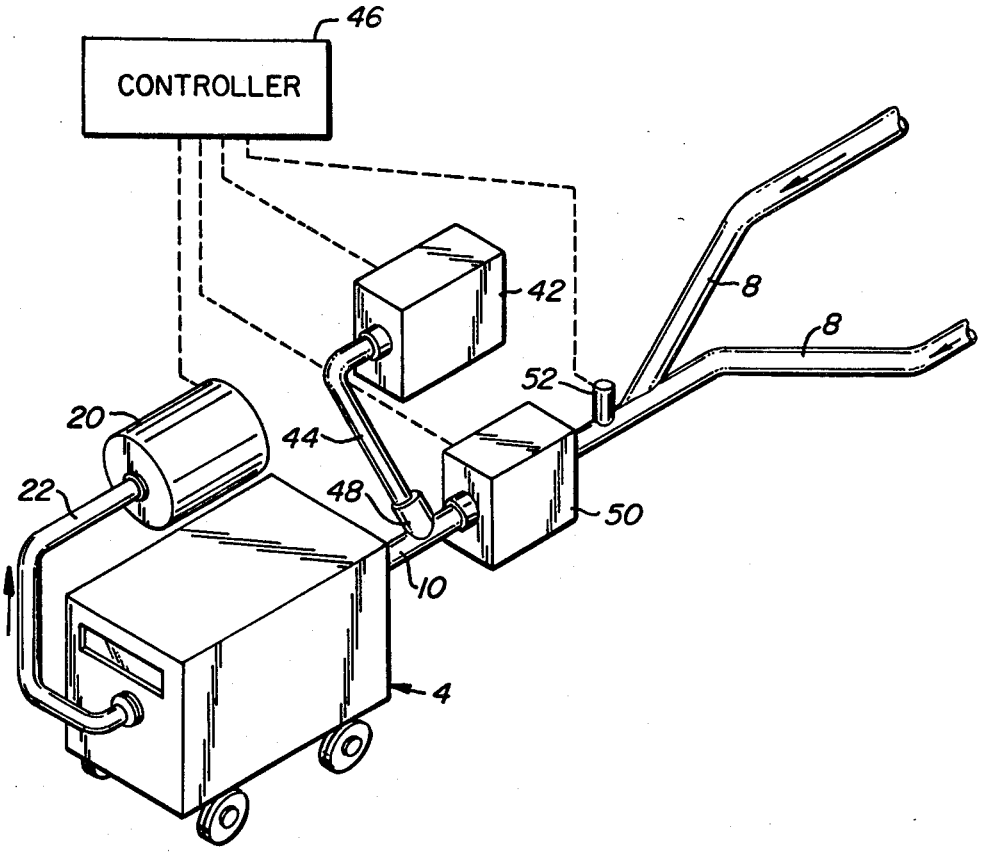
FIG. 5 is similar to FIG. 2 but includes a shredder and a heat sensor mounted to the main collection line.

Turning now to FIG. 5, an alternative embodiment of a portion of the invention is shown. In particular, two features, a shredder 50 and a heat sensor 52 are added along common line 10 upstream of outlet 48 of dosing line 44. Sensor 52 is coupled to controller 46. When heat sensor 52 senses a burning object passing thereby it produces a signal to controller 46 which activates water dispenser 42 for a pre-determined time period. The time period is chosen to ensure that the sensed burning material is dosed with water prior to entering interior 18 of main receptacle 4. Shredder 50 is used to shred the trash prior to entering receptacle 4 for more compact storage. Shredder 50 is activated by controller 46 whenever pump 20 is operating.

Modification and variation can be made to the disclosed embodiments without departing from the substance of the invention as defined in the following claims.

I claim:

1. A trash collection system comprising:

a main receptacle for storing collected trash;

means for drawing a partial vacuum within said main receptacle;

a vacuum line network including a plurality of feeder lines and a main collection line fluidly coupling said main receptacle with said feeder lines;

said vacuum feeder lines including sealable lid assemblies at an end of said feeder line, said lid assembly operable to admit trash into said feeder line whereupon the trash is drawn through said vacuum line network to be deposited into said main receptacle; and means for dosing a fire extinguishing substance into said vacuum line network to extinguish lit trash drawn through said vacuum line network.

2. The trash collection system of claim 1 wherein said main receptacle has a window for visually determining the fill level therein.

3. The trash collection system of claim 1 wherein said lid assembly includes a removable cap for substantially sealing said feeder line end when fitted thereon and for providing generally unhindered access to said feeder line end when removed therefrom.

4. The trash collection system of claim 3 further comprising hinge means for hingedly attaching said cap to said feeder line end.

5. The trash collection system of claim 4 wherein said hinge means is a spring loaded hinge means.

6. The trash collection system of claim 3 wherein said cap includes an opening formed centrally therein and wherein said lid assembly further comprises a spring biased flap mounted to said cap to normally cover said opening.

7. The trash collection system of claim 6 wherein said spring biased flap is mounted to a lower surface of said cap.

8. The trash collection system of claim 1 wherein said fire extinguishing substance is a liquid.

9. The trash collection system of claim 8 wherein said dosing means includes a liquid line fluidly connected to said main collection line.

10. The trash collection system of claim 9 wherein said liquid line is fluidly connected to said main collection line between all of said vacuum feeder lines and said main receptacle.

11. The trash collection system of claim 1 further comprising controller means for controlling the operation of said vacuum drawing means and said dosing means.

12. The trash collection system of claim 11 wherein said controller means is configured to actuate said liquid dosing means whenever said vacuum drawing means is operational.

13. The trash collection system of claim 11 further comprising a heat sensor means, mounted to said vacuum line network upstream of said dosing means and operably coupled to said controller means, for actuating said dosing means for a time in response to a burning object passing thereby.

14. The trash collector of claim 1 further comprising a trash shredding means for shredding trash drawn through said vacuum line network.

15. A trash collection system for use on a vehicle of the type including rows of seats comprising:

a main receptacle for storing collected trash;

means for drawing a partial vacuum within said main receptacle;

a vacuum line network including a plurality of feeder lines and a main collection line fluidly coupling said main receptacle with said feeder lines;

said vacuum feeder lines including sealable lid assemblies at an end of said feeder line, said lid assembly operable to admit trash into said feeder line whereupon the trash is drawn through said vacuum line network to be deposited into said main receptacle, said lid assembly including a removable cap for substantially sealing said feeder line end when fitted thereon and for providing generally unhindered access to said feeder line end when removed therefrom; and means for dosing liquid into said main collection line at a point between all of said feeder lines and said main receptacle to extinguish lit trash drawn through said vacuum line network.

* * * * *